US010667613B2

(12) United States Patent
Harris

(10) Patent No.: US 10,667,613 B2
(45) Date of Patent: Jun. 2, 2020

(54) THERAPEUTIC CUSHION

(71) Applicant: Darlene Harris, Richmond, CA (US)

(72) Inventor: Darlene Harris, Richmond, CA (US)

( * ) Notice: Subject to any disclaimer, the term of this patent is extended or adjusted under 35 U.S.C. 154(b) by 0 days.

(21) Appl. No.: 16/189,829

(22) Filed: Nov. 13, 2018

(65) Prior Publication Data

US 2019/0142166 A1 May 16, 2019

Related U.S. Application Data

(60) Provisional application No. 62/585,485, filed on Nov. 13, 2017.

(51) Int. Cl.

| | |
|---|---|
| ***A47C 7/02*** | (2006.01) |
| ***A47C 7/14*** | (2006.01) |
| ***A47C 7/46*** | (2006.01) |
| ***A47C 7/42*** | (2006.01) |
| ***A47C 27/14*** | (2006.01) |
| *A47C 31/11* | (2006.01) |

(52) U.S. Cl.

CPC ..... *A47C 7/021* (2013.01); *A47C 7/14* (2013.01); *A47C 7/425* (2013.01); *A47C 7/46* (2013.01); *A47C 27/14* (2013.01); *A47C 31/11* (2013.01)

(58) Field of Classification Search

None

See application file for complete search history.

(56) References Cited

U.S. PATENT DOCUMENTS 4,819,287 A * 4/1989 Halverson ..... A47C 20/025 5/631
4,822,309 A * 4/1989 Vandenberg ..... A45C 9/00 297/188.01
4,980,940 A * 1/1991 Isshiki ..... A47C 21/046 5/724
5,288,132 A * 2/1994 Vaughn ..... A47C 7/021 297/452.22
5,448,790 A * 9/1995 Saro ..... A47C 17/045 5/427
5,833,319 A * 11/1998 Davis ..... A47C 7/029 297/452.21
5,941,599 A * 8/1999 Roberts ..... A47C 3/16 297/115
6,292,964 B1 * 9/2001 Rose ..... A47G 9/10 5/630
6,929,325 B1 * 8/2005 Goelo ..... A47C 1/16 297/219.1
6,954,957 B2 * 10/2005 Metzger ..... A47C 27/081 5/498
7,020,918 B1 * 4/2006 Tinsley ..... A47C 16/00 5/630

(Continued)

*Primary Examiner* — David E Allred

(74) *Attorney, Agent, or Firm* — Nwamu, P.C.

(57) ABSTRACT

A therapeutic cushioning assembly and method. The assemble provides structural support to a user's buttocks and spine while the user rests in a sitting position for a prolonged period of time. The cushioning assembly provides a firm rectangular cushion and a firm circular cushion comprising a high-density foam. The cushions detachably mate in a perpendicular disposition via magnets within the cushions. The position of the rectangular cushion and circular cushion can be rearranged to provide support for either the buttocks or spine, depending on the dimensions and comfort of the user.

1 Claim, 5 Drawing Sheets

(56) References Cited

U.S. PATENT DOCUMENTS

| | | | | |
|---|---|---|---|---|
| 7,356,863 | B2 * | 4/2008 | Oprandi | A47C 27/082 5/500 |
| 7,892,065 | B2 * | 2/2011 | Vicentelli | A63H 33/108 446/108 |
| D680,347 | S * | 4/2013 | Metcalf | D6/378 |
| 8,783,778 | B2 * | 7/2014 | Nelson | A47C 13/005 248/188 |
| 9,089,230 | B2 * | 7/2015 | Cho | A61F 5/01 |
| 10,070,725 | B2 * | 9/2018 | Nelson | F16B 1/00 |
| 10,098,468 | B2 * | 10/2018 | Olsen | A47C 7/70 |
| 10,123,623 | B2 * | 11/2018 | Nelson | A47C 31/003 |
| 2004/0164602 | A1 * | 8/2004 | Furukawa | B60R 21/02 297/464 |
| 2006/0006715 | A1 * | 1/2006 | Chadwick | A47C 1/03255 297/300.4 |
| 2008/0079306 | A1 * | 4/2008 | Whelan | A47C 7/021 297/452.41 |
| 2008/0271248 | A1 * | 11/2008 | DeLaura | A61G 13/12 5/638 |
| 2012/0119629 | A1 * | 5/2012 | Nelson | A47B 87/00 312/111 |
| 2013/0264852 | A1 * | 10/2013 | Zack | A47C 31/11 297/219.12 |
| 2014/0041091 | A1 * | 2/2014 | Sternlight | B60N 2/882 2/12 |
| 2014/0182060 | A1 * | 7/2014 | Mikkelsen | A47C 21/026 5/400 |
| 2016/0081459 | A1 * | 3/2016 | Amick | A47C 7/383 4/523 |
| 2016/0106217 | A1 * | 4/2016 | Bates | A47C 7/021 297/183.1 |
| 2016/0311354 | A1 * | 10/2016 | Stamm | B60N 2/663 |
| 2018/0228306 | A1 * | 8/2018 | May | A47C 7/383 |
| 2018/0289163 | A1 * | 10/2018 | Clark | A47C 1/143 |
| 2019/0274432 | A1 * | 9/2019 | Rawls | A47C 7/0213 |
| 2019/0335905 | A1 * | 11/2019 | Alexander | A61H 15/00 |

* cited by examiner

THERAPEUTIC CUSHION

FIELD OF THE INVENTION

The present disclosure relates generally to a therapeutic cushioning assembly and method and more specifically a therapeutic cushioning assembly and method for supporting a user's back while in a sitting position.

SUMMARY

Various aspects of a therapeutic cushioning assembly are disclosed. In one aspect, the assembly includes a firm rectangular cushion. The cushion is shaped and dimensioned to support the spine. The rectangular cushion has two opposing rectangular support faces and four equal rectangular edge faces. The rectangular cushion is composed of a high-density foam. The assembly includes a rectangular cover substantially encapsulating the rectangular cushion. The rectangular cover has an inner rectangular surface, an outer rectangular surface, and an inner rectangular cavity sized and dimensioned to receive the rectangular cushion. The rectangular cover can be a resilient fabric.

The therapeutic cushioning assembly includes a first fastener joined with one of the rectangular edge faces; a first handle joined with one of the rectangular edge faces; a firm circular cushion shaped and dimensioned to at least partially support the buttocks, the circular cushion being defined by two opposing circular support faces and a continuous circular edge face, the circular cushion comprising the high-density foam.

The therapeutic cushioning assembly also includes a circular cover substantially encapsulating the circular cushion, the circular cover being defined by an inner circular surface, an outer circular surface, and an inner circular cavity sized and dimensioned to receive the circular cushion, the circular cover comprising the resilient fabric; a second fastener joined with the circular edge face; a second handle joined with the circular edge face; and at least one magnet joining the edges of the cushions, the magnet enabling detachable attachment of the cushions in multiple arrangements, wherein the rectangular cushion supports the spine, or the buttocks, or both, whereby the circular cushion supports the spine, or the buttocks, or both.

DETAILED DESCRIPTION

Reference will now be made in detail to the embodiments of the disclosure, examples of which are illustrated in the accompanying drawings. While the disclosure will be described in conjunction with the preferred embodiments, it will be understood that they are not intended to limit the disclosure to these embodiments. On the contrary, the disclosure is intended to cover alternatives, modifications and equivalents, which may be included within the spirit and scope of the disclosure as defined by the appended claims. Furthermore, in the following detailed description of the present disclosure, numerous specific details are set forth to provide a thorough understanding of the present disclosure. However, it will be obvious to one of ordinary skill in the art that the present disclosure may be practiced without these specific details. In other instances, well-known methods, procedures, components, and circuits have not been described in detail so as to not unnecessarily obscure aspects of the present disclosure.

Figure 1:
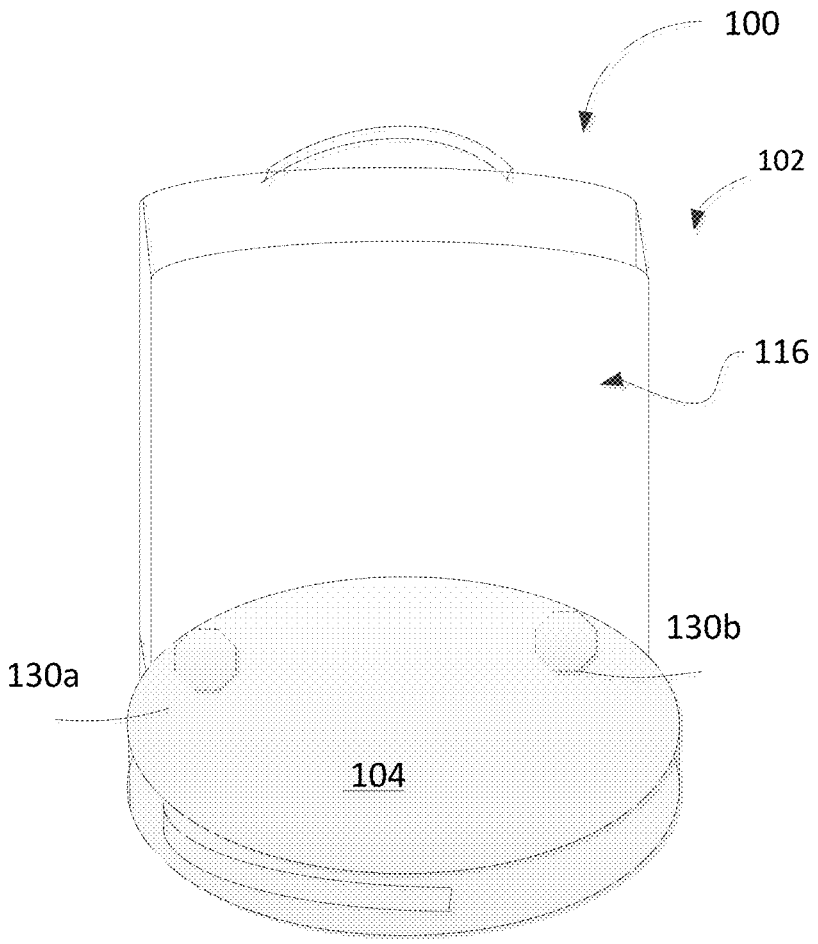
FIG. 1 shows an example of a therapeutic cushioning assembly, in accordance with an exemplary embodiment of the present disclosure.

FIG. 1 shows an example of a therapeutic cushioning assembly 100 of the present disclosure.

The therapeutic cushioning assembly 100 provides the requisite structural support needed for a user's buttocks and back when the user is seated for prolonged periods of time. In one example, the cushioning assembly 100 includes a firm rectangular cushion 102 and a firm circular cushion 104, both made of firm high-density foam. The firm rectangular cushion 102 is positioned along the back section of a chair while the circular cushion 104 is placed on the seat of a chair. When assembled the planes of the firm rectangular cushion 102 and that of the circular cushion 104 are substantially perpendicular.

However, one skilled in the art will recognize that the opposite arrangement may be utilized. That is, the circular cushion 104 may be positioned along the back of a chair, while the rectangular cushion 102 is placed on the seat of the chair. In fact, each one of the rectangular cushion 102 and the circular cushion 104 may be used alone, separate and apart, one without the other, in either position of a chair. For example, the circular cushion 104 can be placed on the sitting surface of the chair without using the rectangular cushion 102 along the back section of the chair. In such a case, the user would sit on circular cushion 104 and would rely on the back portion (if any) of the chair to provide support for the back. So also, the rectangular cushion 102 can be placed on the sitting surface of the chair or positioned along the back of the chair without using the circular cushion 104.

The rectangular cushion 102 and the circular cushion 104 are detachably coupled by one or more magnets in a perpendicular disposition at their edges to provide support for the buttocks and spine. At least one or more magnets 130*a*, 130*b* detachably attach the cushions to each other at their edges. These magnets not only serve to detachably couple the two cushions to each other, the magnets also provide therapy to the buttocks and spine by altering the user's bio-energetic field. The high-density foam of the cushions 102, 104 combine with the magnets to alleviate tissue and nerve damage caused by prolonged pressure on localized areas of the body, especially the spine and lower legs regions of the body.

Figure 2:
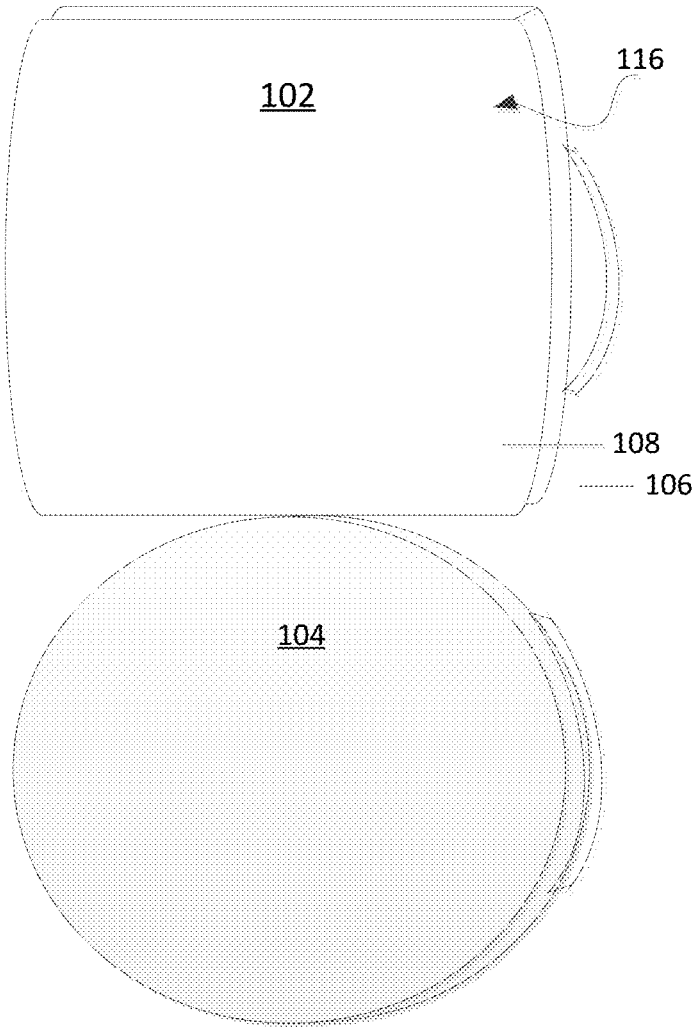
FIG. 2 shows a top view of a rectangular cushion positioned adjacently to a circular cushion, in accordance with an exemplary embodiment of the present disclosure.

As shown in FIG. 2, the cushioning assembly 100 comprises a firm rectangular cushion 102 shaped and dimensioned to support the spine. The rectangular cushion 102 is defined by two opposing rectangular support faces 116 and four equal rectangular edge faces 106. The rectangular cushion 102 is also defined by a high-density foam. In one non-limiting embodiment, the high-density foam has a 1.8 or higher resiliency. In one embodiment, the high-density foam has a high weight per cubic foot, and a strong cell structure, which makes the material highly durable and long-lasting.

The cushioning assembly 100 also provides a rectangular cover 108 that is sized and dimensioned to substantially encapsulate the rectangular cushion 102. The rectangular cover is defined by an inner rectangular surface, an outer rectangular surface, and an inner rectangular cavity sized and dimensioned to receive the rectangular cushion.

Figure 3A:
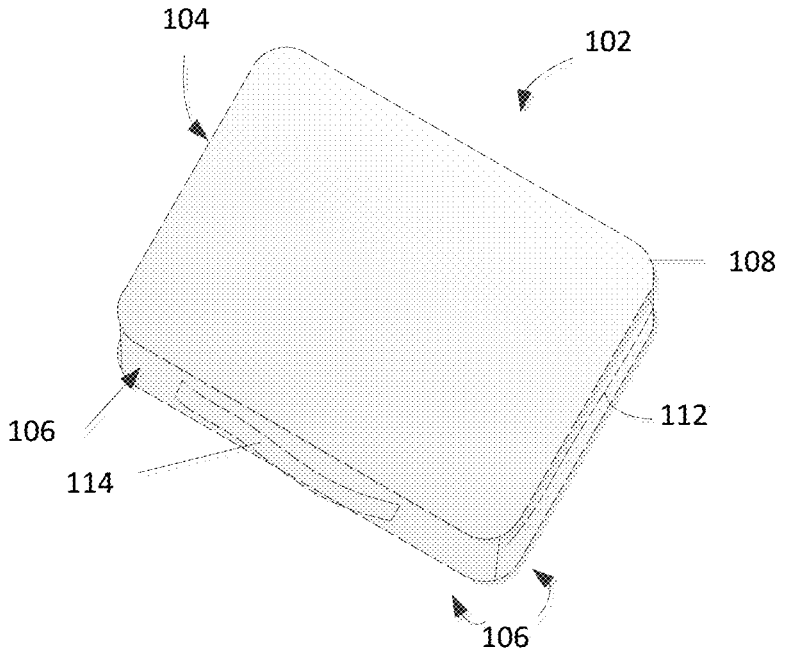
FIG. 3A shows a rectangular cushion with a handle in accordance with an exemplary embodiment of the present disclosure.
Figure 3B:
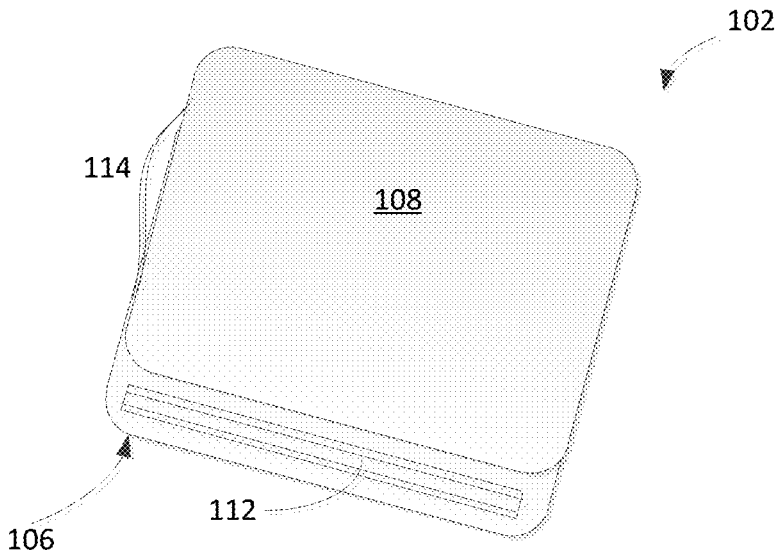
FIG. 3B shows the rectangular cushion with a fastener, in accordance with an exemplary embodiment of the present disclosure.

As shown in FIGS. 3A and 3B, the rectangular cover 108 also includes a first fastener 112 at one of the rectangular edge faces 106. The first fastener 112 secures the rectangular cushion 102 in the inner rectangular cavity. The first fastener 112 may include, without limitation, a zipper, a hook and loop fastener, and a button. In operation, once the rectangular cushion 102 is positioned inside the rectangular cover 108, the first fastener 112 closes an opening in the rectangular cover 108 to secure the rectangular cushion 102 inside the cavity of the rectangular cover 108. To remove the rectangular cushion 102, the first fastener 112 is opened and the cushion is removed.

Further, the rectangular cover 108 comprises a first handle 114 that extends from one of the rectangular edge faces 106 (FIG. 3A). The first handle 114 is U-shaped and resilient. The first handle 114 can be gripped to allow the user to carry and rearrange the rectangular cushion 102 in relation to the circular cushion 104, as described below.

Figure 4A:
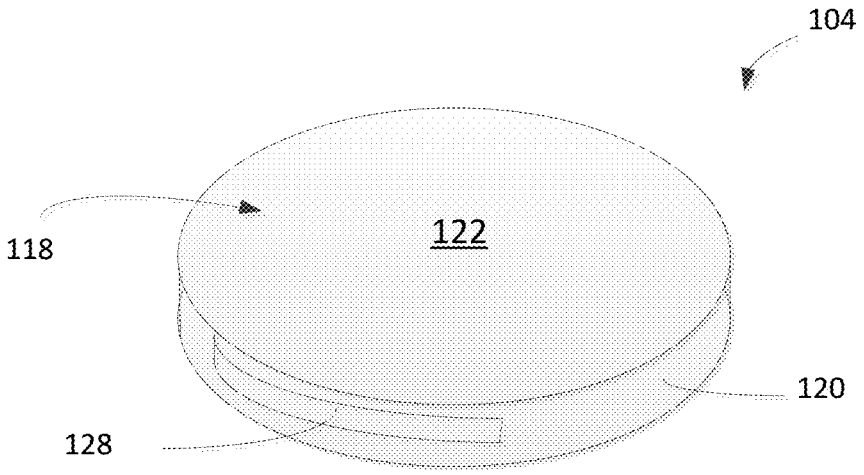
FIG. 4A shows an example circular cushion with a handle.

FIG. 4A shows the firm circular cushion 104 that is shaped and dimensioned to support the spine. The circular cushion 104 is defined by two opposing circular support faces 118 and a continuous circular edge face 120. The circular cushion 104 is also defined by a high-density foam, like the rectangular cushion 102. In one non-limiting embodiment, the high-density foam has a 1.8 high resiliency, or higher.

The rectangular and circular cushions 102, 104 are configured to support the weight of the user by positioning under the buttocks, and positioning in alignment with the back, so as to support the back, i.e., spine. Since the rectangular cushion 102 is longer and narrower, it can be used to support the spine, while the circular cushion 104, matching the shape of the buttocks, supports positions beneath the buttocks to support the weigh to the user (FIG. 1). Thus, the circular cushion 104 is preferably used to sit directly on, while the rectangular cushion 102 aligns with the spine, such that the user can lean back on the rectangular cushion 102.

However, since the rectangular and circular cushions 102, 104 are interchangeable, the user can choose to sit on the rectangular cushion 102, and lean back against the spin back on the circular cushion 104. In yet another possible use of the cushioning assembly 100, the user can detach the circular cushion 104 from the rectangular cushion 102 and sit on, or lean back on either cushion, as shown in FIG. 2. The cushions 102, 104 can be used while in a standard sitting position, or while lying down. In an alternative embodiment, either cushion 102, 104 can support the head.

A circular cover 122 is provided to substantially encapsulate the circular cushion 104. The circular cover 122 may be fabricated from a fabric that is resilient, breathable, and machine-washable. The outer circular surface 124 may have different colors, images, patterns, and textures.

Figure 4B:
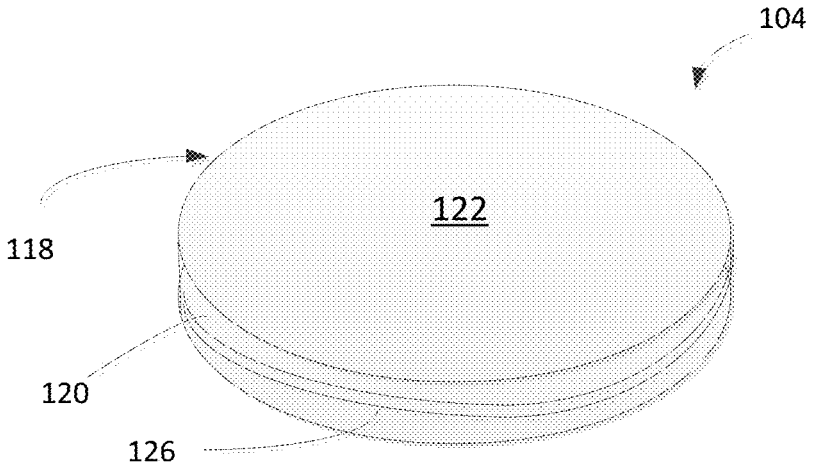
FIG. 4B shows another example of a cushion fastener, in accordance with an exemplary embodiment of the present disclosure.

As FIG. 4B shows, the circular cover 122 also includes a second fastener 126 joined with the circular edge face 120. The second fastener 126 secures the circular cushion 104 in the inner circular cavity. The second fastener 126 may include, without limitation, a zipper, a hook and loop fastener, and a button. In operation, once the circular cushion 104 is positioned inside the circular cover 122, the second fastener 126 closes an opening to secure the circular cushion 104 inside the circular cavity of the circular cover 122.

Further, the circular cover 122 comprises a second handle 128 that extends from one of the circular edge face 120 (FIG. 4A). The second handle 128 is U-shaped and resilient. The second handle 128 can be gripped to allow the user to carry and rearrange the circular cushion 104 in relation to the circular cushion 104, as described below.

As discussed above, the rectangular and circular cushions 102, 104 are arranged to join adjacently, with the circular cushion 104 aligned with the buttocks, and the rectangular cushion 102 aligned with the spine. This connectivity may be performed with at least one magnet 130*a*, 130*b* that are integral with the covers. The magnet 130*a*, 130*b* enables detachable attachment with minimal force applied. In this manner, the rectangular and circular cushions 102, 104 can be arranged to support any combination of spine, buttocks, and other parts of the body, such as the lower legs and head. Also, the magnets 130*a*, 130*b* enables detachment of one of the cushions for separate use.

Figure 5:
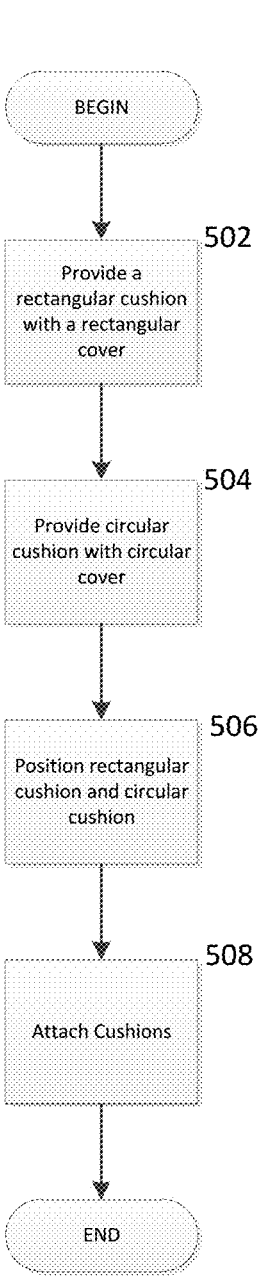
FIG. 5 shows a flowchart of a method for receiving therapy with a cushioning assembly, in accordance with an exemplary embodiment of the present disclosure.

FIG. 5 is a method 500 for receiving therapy with a cushioning assembly. The method may include an initial block 502 of providing a rectangular cushion with a rectangular cover. The rectangular cushion is shaped and dimensioned to at least partially support the spine, the rectangular cushion comprising a high-density foam of resiliency of 1.8.

The method 500 may further includes at block 504, providing a circular cushion with a circular cover, the circular cushion shaped and dimensioned to at least partially support the spine, the circular cushion comprising the high-density foam A block 506, the method positions the rectangular cushion adjacent and perpendicular to the circular cushion.

At block 508, the method includes fastening the edge of the rectangular cushion to the edge of the circular cushion through at least one magnet such that the circular cushion can receive the buttocks of a user and the rectangular cushion can receive the back of a user to provide spine support.

Although the process-flow diagrams show a specific order of executing the process steps, the order of executing the steps may be changed relative to the order shown in certain embodiments. Also, two or more blocks shown in succession may be executed concurrently or with partial concurrence in some embodiments. Certain steps may also be omitted from the process-flow diagrams for the sake of brevity. In some embodiments, some or all the process steps shown in the process-flow diagrams can be combined into a single process.

While the above is a complete description of exemplary specific embodiments of the disclosure, additional embodiments are also possible. Thus, the above description should not be taken as limiting the scope of the disclosure, which is defined by the appended claims along with their full scope of equivalents.

I claim:

1. A therapeutic cushioning assembly, the assembly comprising:

a firm rectangular cushion shaped and dimensioned to at least partially support a spine of a user, the rectangular cushion being defined by two opposing rectangular support faces and four equal height rectangular edge faces, the rectangular cushion comprising a high-density foam;

a rectangular cover substantially encapsulating the rectangular cushion, the rectangular cover being defined by an inner rectangular surface, an outer rectangular surface, and an inner rectangular cavity sized and dimensioned to receive the rectangular cushion, the rectangular cover comprising a resilient fabric;

a first fastener joined with one of the rectangular edge faces;

a first handle joined with one of the rectangular edge faces;

a firm circular cushion shaped and dimensioned to at least partially support a buttocks of the user, the circular cushion being defined by two opposing circular support faces and a continuous circular edge face, the circular cushion comprising the high-density foam;

a circular cover substantially encapsulating the circular cushion, the circular cover being defined by an inner circular surface, an outer circular surface, and an inner circular cavity sized and dimensioned to receive the circular cushion, the circular cover comprising the resilient fabric;

a second fastener joined with the circular edge face;

a second handle joined with the circular edge face; and at least one magnet supported by at least one of the circular cushion and the rectangular cushion at one of the edge faces, the at least one magnet joining the edge faces of the cushions, the magnet enabling detachable attachment of the cushions in multiple arrangements, whereby the rectangular cushion supports the spine, or the buttocks, or both, whereby the circular cushion supports the spine, or the buttocks, or both.

* * * * *